US010309141B2

(12) United States Patent
Rommelmann

(10) Patent No.: US 10,309,141 B2
(45) Date of Patent: Jun. 4, 2019

(54) DOMESTIC APPLIANCE AND HINGE OF A DOMESTIC APPLIANCE

(71) Applicant: HETTICH-ONI GMBH & CO. KG, Vlotho (DE)

(72) Inventor: Cord Rommelmann, Butjadingen / Burhave (DE)

(73) Assignee: HETTICH-ONI GMBH & CO. KG, Vlotho (DE)

( * ) Notice: Subject to any disclaimer, the term of this patent is extended or adjusted under 35 U.S.C. 154(b) by 0 days.

(21) Appl. No.: 15/554,611

(22) PCT Filed: Mar. 2, 2016

(86) PCT No.: PCT/EP2016/054406

§ 371 (c)(1),
(2) Date: Aug. 30, 2017

(87) PCT Pub. No.: WO2016/139238

PCT Pub. Date: Sep. 9, 2016

(65) Prior Publication Data

US 2018/0238093 A1 Aug. 23, 2018

(30) Foreign Application Priority Data

Mar. 5, 2015 (DE) ..... 10 2015 103 234

(51) Int. Cl.
*E05D 15/06* (2006.01)
*E05F 1/08* (2006.01)
(Continued)

(52) U.S. Cl.
CPC ..... *E05F 3/20* (2013.01); *D06F 39/12* (2013.01); *E05D 3/122* (2013.01); *E05D 5/02* (2013.01);
(Continued)

(58) Field of Classification Search
CPC ..... E05F 3/20; E05F 3/14; E05F 3/16; E05F 3/22; E05F 1/12; E05F 1/1284;
(Continued)

(56) References Cited

U.S. PATENT DOCUMENTS 1,352,602 A * 9/1920 Herzog ..... E05C 17/085 217/60 D
1,707,511 A * 4/1929 Cornwell ..... A45C 13/34 16/348
(Continued)

FOREIGN PATENT DOCUMENTS

DE 1243561 6/1967
DE 3140039 A1 * 4/1983 ..... A47L 15/4261
(Continued)

OTHER PUBLICATIONS

International Search Report of PCT/EP2016/054406 dated May 9, 2016.
(Continued)

*Primary Examiner* — Chuck Y Mah
(74) *Attorney, Agent, or Firm* — Barnes & Thornburg LLP

(57) ABSTRACT

The invention relates to a hinge for a domestic appliance for pivotably fastening a lid to a body of the domestic appliance, comprising a first hinge element and a second hinge element, which are pivotably connected to each other and which can be pivoted in relation to each other between an open position and a closed position. The hinge is characterized in that a control lever is rotatably supported on the first hinge element and a control gate is formed on the second hinge element, in which control gate a control pin formed on the control lever is guided, wherein the control gate is shaped in such a way that, during a closing motion of the hinge, an intermediate position is assumed and held until the closing motion is continued to the closed position, whereas the hinge is
(Continued)

pivoted to the open position during an opening motion from the closed position. The invention further relates to a domestic appliance, in particular a top-loading washing machine, comprising a body, to which a lid is pivotably fastened by means of at least one such hinge.

18 Claims, 7 Drawing Sheets

(51) Int. Cl.

| | |
|---|---|
| ***E05F 3/20*** | (2006.01) |
| ***E05F 1/12*** | (2006.01) |
| ***D06F 39/12*** | (2006.01) |
| ***E05D 3/12*** | (2006.01) |
| ***E05D 5/02*** | (2006.01) |
| ***E05D 11/10*** | (2006.01) |
| ***E05F 3/16*** | (2006.01) |
| ***E05F 3/22*** | (2006.01) |
| ***E05F 5/02*** | (2006.01) |
| *E05F 3/14* | (2006.01) |

(52) U.S. Cl.
CPC ..... *E05D 11/1007* (2013.01); *E05F 1/12* (2013.01); *E05F 1/1284* (2013.01); *E05F 3/16* (2013.01); *E05F 3/22* (2013.01); *E05F 5/02* (2013.01); *E05F 3/14* (2013.01); *E05Y 2201/21* (2013.01); *E05Y 2201/218* (2013.01); *E05Y 2201/48* (2013.01); *E05Y 2800/26* (2013.01); *E05Y 2800/465* (2013.01); *E05Y 2800/674* (2013.01); *E05Y 2900/312* (2013.01)

(58) Field of Classification Search
CPC ... E05F 5/02; E05D 3/122; E05D 2/02; E05D 11/1007; E05Y 2201/21; E05Y 2201/218; E05Y 2201/48; E05Y 2201/266; E05Y 2800/26; E05Y 2800/465; E05Y 2800/674; E05Y 2900/312; D06F 39/12
See application file for complete search history.

(56) References Cited

U.S. PATENT DOCUMENTS

| | | | | | |
|---|---|---|---|---|---|
| 2,001,507 | A * | 5/1935 | Stribling | E05C 17/085 | 16/333 |
| 2,076,860 | A * | 4/1937 | North | E05C 17/085 | 217/60 C |
| 2,195,093 | A * | 3/1940 | Neal | E05C 17/32 | 16/333 |
| 2,812,802 | A * | 11/1957 | Gielow | B64D 25/06 | 297/396 |
| 3,378,880 | A * | 4/1968 | Haldopoulos | E05D 11/1014 | 16/337 |
| 3,906,587 | A * | 9/1975 | Little | E05F 1/1261 | 16/289 |
| 3,952,367 | A * | 4/1976 | Schnelle | E05D 5/0246 | 16/253 |
| 4,914,781 | A * | 4/1990 | Sokn | D06F 39/14 | 16/225 |
| 5,169,257 | A * | 12/1992 | Liou | A47C 20/045 | 16/333 |
| 5,894,634 | A * | 4/1999 | Nithammer | B60N 2/20 | 16/325 |
| 6,530,498 | B1 * | 3/2003 | Ovadia | A45C 13/007 | 16/286 |
| 6,766,563 | B2 * | 7/2004 | Lee | A23B 7/0425 | 16/281 |
| 7,798,541 | B2 * | 9/2010 | Hirtsiefer | E05C 17/345 | 292/262 |
| 7,845,053 | B2 * | 12/2010 | Marsh | E05D 11/06 | 16/286 |
| 8,429,795 | B2 * | 4/2013 | Huachun | A47C 17/162 | 16/321 |
| 8,938,854 | B2 * | 1/2015 | Lanzani | E05D 3/14 | 16/288 |
| 9,677,309 | B2 * | 6/2017 | Zhou | G07D 11/00 | |
| 2007/0283532 | A1 * | 12/2007 | Vanini | E05F 1/1261 | 16/277 |
| 2009/0064458 | A1 * | 3/2009 | Vanini | E05F 1/1261 | 16/304 |
| 2010/0229344 | A1 | 9/2010 | Donoho | | |
| 2010/0281650 | A1 * | 11/2010 | Kleennann | A47L 15/4261 | 16/64 |
| 2012/0060323 | A1 * | 3/2012 | Lee | E05D 15/582 | 16/275 |
| 2014/0375189 | A1 | 12/2014 | Kihyuk et al. | | |
| 2016/0215547 | A1 * | 7/2016 | Choi | E05D 11/1007 | |

FOREIGN PATENT DOCUMENTS

| | | | | |
|---|---|---|---|---|
| DE | 10362318 | | 2/2011 | |
| EP | 2657394 | | 10/2013 | |
| EP | 2703590 | | 3/2014 | |
| GB | 975747 | A * | 11/1964 | E05F 1/1058 |

OTHER PUBLICATIONS

English translation of International Search Report of PCT/EP2016/054406 dated May 9, 2016.
Search Report issued in German Application No. 102015103234.1 dated Jul. 30, 2015.

* cited by examiner

DOMESTIC APPLIANCE AND HINGE OF A DOMESTIC APPLIANCE

CROSS REFERENCE TO RELATED APPLICATIONS

This application is a U.S. nationalization under 35 U.S.C. § 371 of International Application No. PCT/EP2016/054406, filed Mar. 2, 2016, which claims priority to German Application No. 102015103234.1 filed Mar. 5, 2015.

BACKGROUND AND SUMMARY OF THE DISCLOSURE

The disclosure relates to a hinge of a domestic appliance for pivotably fastening a lid to a body of the domestic appliance. The hinge has a first hinge element and a second hinge element, which are connected to one another via a pivot axis and can be pivoted in relation to one another between an open position and a closed position. The disclosure furthermore relates to a domestic appliance, for example, a top-loading washing machine, having at least one such hinge.

In a top loading washing machine, the washing drum is loaded and unloaded from above. For this purpose, the washing machine is provided with a lid, which is folded down into a horizontal position in operation and which can be pivoted up into a vertical or approximately vertical position for loading. In addition to the more convenient loading ability, such washing machines can be constructed as particularly narrow and space-saving due to the alignment of the washing drum. Other domestic appliances such as freezer cabinets and some types of cooking devices can also be designed as devices which can be loaded and unloaded from above and have a pivotable lid.

For example, a hinge of the type mentioned at the outset can be used for the pivotable mounting of such a lid on a body of the domestic appliance, which hinge has two hinge elements pivotable in relation to one another about a pivot axis, which are connected to the body on one side and to the lid on the other side. Two such hinges are typically used for mounting a lid.

A hinge of this type is known, for example, from document DE 1 243 561. In this hinge, a lever having an attached roller is pivotably mounted in the hinge housing. The roller is pressed by a compression spring against a cam-like attachment, which is formed on the cover-side hinge part. The cam is shaped so that the opening of the lid is assisted by spring force, on the one hand, and the lid is also held in the closed position by the application of spring force, on the other hand.

Document DE 103 62 318 B4 describes a hinge having comparable functionality for mounting a door of a domestic appliance. In this hinge, a function lever is arranged on a hinge part, which interacts with a slotted guide arranged on the second hinge part. The interaction of function lever and slotted guide limits the pivot angle range of the hinge and latches the hinge in the respective end positions.

In addition to the mentioned end positions of the hinge, in which the lid of the domestic appliance is completely closed or completely open, in particular in the case of top-loading washing machines, an intermediate position is desirable, in which the lid is slightly open. In this intermediate position, the washing machine drum is ventilated, so that even in longer times of nonuse, odor formation within the drum is prevented. Compared to a completely open lid for this purpose, however, a more appealing visual impression is achieved and the risk that objects will unintentionally fall into the washing machine drum is reduced. The latter is relevant in particular for washing machines which are placed in a living space, for example, a bathroom.

A hinge according to the disclosure of the type mentioned at the outset is distinguished in that a control lever is rotatably mounted on the first hinge element and a control curve is formed on the second hinge element, in which a control pin formed on the control lever is guided. The control curve is formed in this case so that during a closing movement of the hinge from the open position, an intermediate position is assumed and held until the closing movement is continued into the closed position, while in contrast during an opening movement out of the closed position, the hinge pivots into the open position.

According to the disclosure, the intermediate position of the hinge, providing for ventilation of the washing machine drum upon use of the hinge in a washing machine, is achieved by the interaction of the control lever and a corresponding control curve. The control curve is formed in this case so that the intermediate position is only assumed upon movement of the hinge in one direction, upon movement in the closing direction here, while in contrast upon movement of the lid in the other direction, the opening movement in the present case, the hinge is pivoted past the intermediate position from the closed position into the open position.

The mentioned combination of rotatably mounted control lever and control curve can be integrated in a space-saving manner into the hinge. The achieved movement sequence is advantageously incorporated into the operation, for example, of a top-loading washing machine. After ending the washing program, from the closed position of the lid, it can be moved directly into the open position, to be able to remove laundry from the laundry drum. The lid is then pivoted down again and remains in the intermediate position to ventilate the washing machine drum, which intermediate position may be associated with a joint angle which differs only slightly from that in the closed position. For further loading of the washing machine, a press on the lid is sufficient, which moves the lid into the closed position, whereby the intermediate position is left. The lid can thereafter be pivoted immediately back into the open position, to be able to load the machine again.

In one embodiment of the hinge, the first and the second hinge elements are formed as U-shaped, each having a base and legs arranged laterally on the base, wherein the legs of the second hinge element encompass the legs of the first hinge element in the region of a pivot axis. The first and the second hinge elements are preferably produced from sheet metal in a stamping and bending process. The hinge can thus be manufactured simply and cost-effectively. A more compact construction is also possible, in particular if the control lever is mounted on one of the legs of the first hinge element and the control curve is formed in one of the legs of the second hinge element. The control curve can be embossed into the legs in a deep embossing process, for example.

To implement the described movement sequence, in a further advantageous embodiment of the hinge, the control curve at least sectionally forms a circumferential path for the control pin. The circumferential path of the control curve particularly preferably extends in a heart shape. A path extending in a heart shape has a notch between the two heart halves, which forms a catch groove, in which the control pin engages in the intermediate position. A further section of the control curve, in which the control pin enters the open position of the hinge, can adjoin the circumferential section of the control curve.

The heart-shaped control curve can be formed in the mentioned deep embossing process. Alternatively, an outer contour of the control curve can be formed by a stamped-out recess in the leg, for example, and an inner contour of the circumferential path of the control curve can be provided by an insert, which is inserted into the recess. In this case, the insert has the catch groove.

In a further embodiment of the hinge, the control lever is formed as spring-like and/or spring-mounted and/or the insert is fixed in a spring-like manner on the leg. The control pin can thus disengage from the catch groove and the control curve during an opening movement of the hinge, which is initially not provided in the movement sequence. Damage to the hinge is thus prevented if, for example, the lid of the domestic appliance is forcefully opened from the latched intermediate position.

In a further embodiment, the hinge has a damper, which at least sectionally damps a movement of the two hinge elements in relation to one another. A material-protecting approach to one or both end positions of the hinge can be achieved by the damper. The damper is preferably a rotation damper having a gearwheel, which is fastened on one hinge element, wherein a gearwheel segment, in which the gearwheel engages, is formed on the other hinge element. In this way, the damper can be integrated in a space-saving manner into the hinge. The hinge segment is preferably dimensioned and arranged so that the gearwheel first engages in the gearwheel segment upon approach to at least one end position of the hinge.

In a further embodiment, the hinge has a spring, in particular a leaf spring, which is arranged between the two hinge elements. At least one of the end positions is assumed automatically due to the spring. As a leaf spring, the spring arms of which extend in parallel to the respective base of the hinge elements, the spring can be integrated into the hinge, without space problems occurring with the catch mechanism or a possibly provided damper.

A domestic appliance according to the invention, in particular a top-loading washing machine, is distinguished by a body on which a lid is pivotably fastened using at least one above-mentioned hinge.

DETAILED DESCRIPTION OF THE DRAWINGS

Figure 1C:
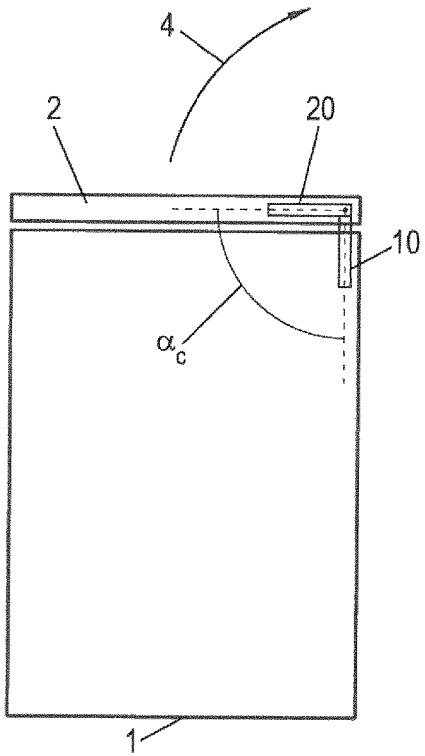
FIGS. 1*a-c* each show a schematic side view of a domestic appliance having a pivotable lid in various pivot positions of the lid.
Figure 1B:
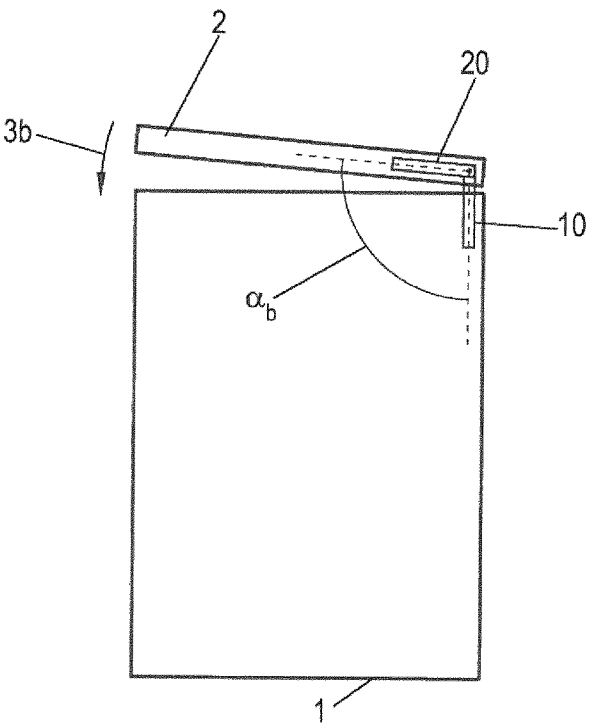
Figure 1A:
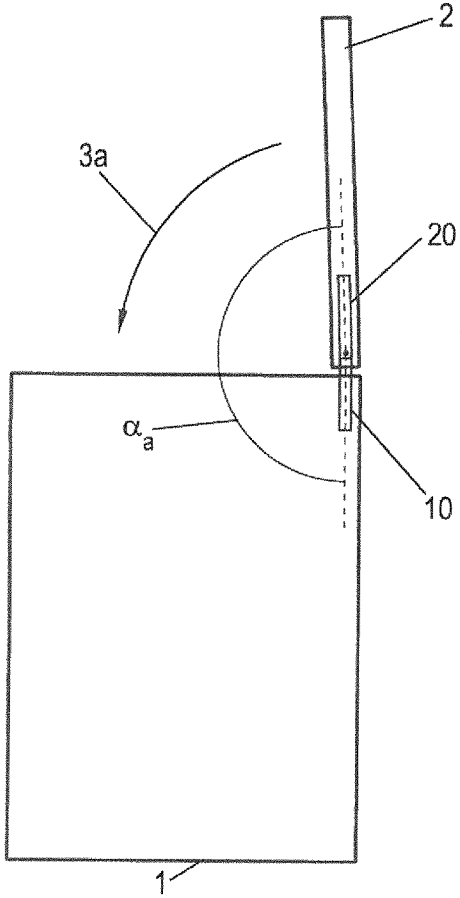

FIGS. 1*a*-1*c* each show a top-loading washing machine as an example of a domestic appliance in a schematic side view. The washing machine has a body 1 having a pivotable lid 2. Body 1 and lid 2 are connected to one another via at least one hinge, for example, by two hinges. An illustrative hinge is shown in FIGS. 1*a-c*. The hinge has a first hinge element 10, which is connected to the body 1, and a second hinge element 20, which is connected to the lid 2. The hinge is embodied as a single-joint hinge having a pivot axis, on which the two hinge elements 10, 20 are pivotably connected to one another.

FIGS. 1*a-c* each show different open positions of the lid 2. FIG. 1 shows the washing machine with the lid 2 completely open. In this open position of the lid 2, it stands vertically or nearly vertically upward. Because of the installation location of the hinge, the open position of the lid 2 corresponds to an extended or nearly extended arrangement of the hinge elements 10, 20 in relation to one another. The angle of the hinge elements 10, 20 in relation to one another is referred to hereafter as the joint angle $\alpha$. The joint angle $\alpha$ assumes a value $\alpha_a$ of nearly 180°, in the present example 178°, in the open position of the lid 2 shown in FIG. 1*a*. In alternative embodiments, the open angle $\alpha_a$ can also be exactly 180° or also somewhat greater than 180°. The hinge is designed so that when spring force is applied thereto, it assumes the position shown in FIG. 1*a* as the base position.

By way of a closing movement of the lid 2, symbolized by an arrow 3*a* in FIG. 1*a*, the lid 2 can be moved into the intermediate position shown in FIG. 1*b*. In this intermediate position, the joint angle $\alpha=\alpha_b$ is approximately 95°. In the intermediate position shown in FIG. 1*b*, the hinge engages so that the lid 2 is automatically maintained in the illustrated intermediate position against the spring force of the hinge.

If, as shown by the arrow 3*b* in FIG. 1*b*, the closing movement of the hinge 2 is continued beyond the catch position, the lid finally assumes the closed position shown in FIG. 1*c*. In this position, the joint angle $\alpha=\alpha_c=90°$.

In the closed position of the lid 2 shown in FIG. 1*c*, the spring forces of the hinge still act on the lid 2. If the lid 2 is released from the illustrated position or guided upward using the hands, it opens automatically in an opening movement, which is symbolized by an arrow 4 in FIG. 1*c*, and passes into the open position (FIG. 1*a*). The lid 2 can therefore be opened in a simple manner from the intermediate position of FIG. 1*b*, by pressing it briefly downward (FIG. 1*c*) and then releasing it. A damper is advantageously provided in this case, which brakes the movement of the lid 2 upon approach to the open position of FIG. 1*a*. If operation of the washing machine is to occur in the closed position of the lid 2 (FIG. 1*c*), the lid 2 is held in the closed position by a closure unit arranged in the body 1, until a washing program is ended. It can then be provided that the closing device releases the lid 2, which thereupon automatically pivots into the open position of FIG. 1*a* due to the spring force of the hinge.

It is to be noted that with another arrangement of the hinge elements 10, 20 in relation to the body 1 or the lid 2, another joint angle $\alpha_a$ can be assigned to the open position of the lid 2. A hinge according to the invention can alternatively be designed, for example, so that the joint angle $\alpha_a$ with open position of the lid 2 is in the range of 90° and the joint angle $\alpha_c$ in the closed position of the lid 2 is in the range of 0°.

Figure 2:
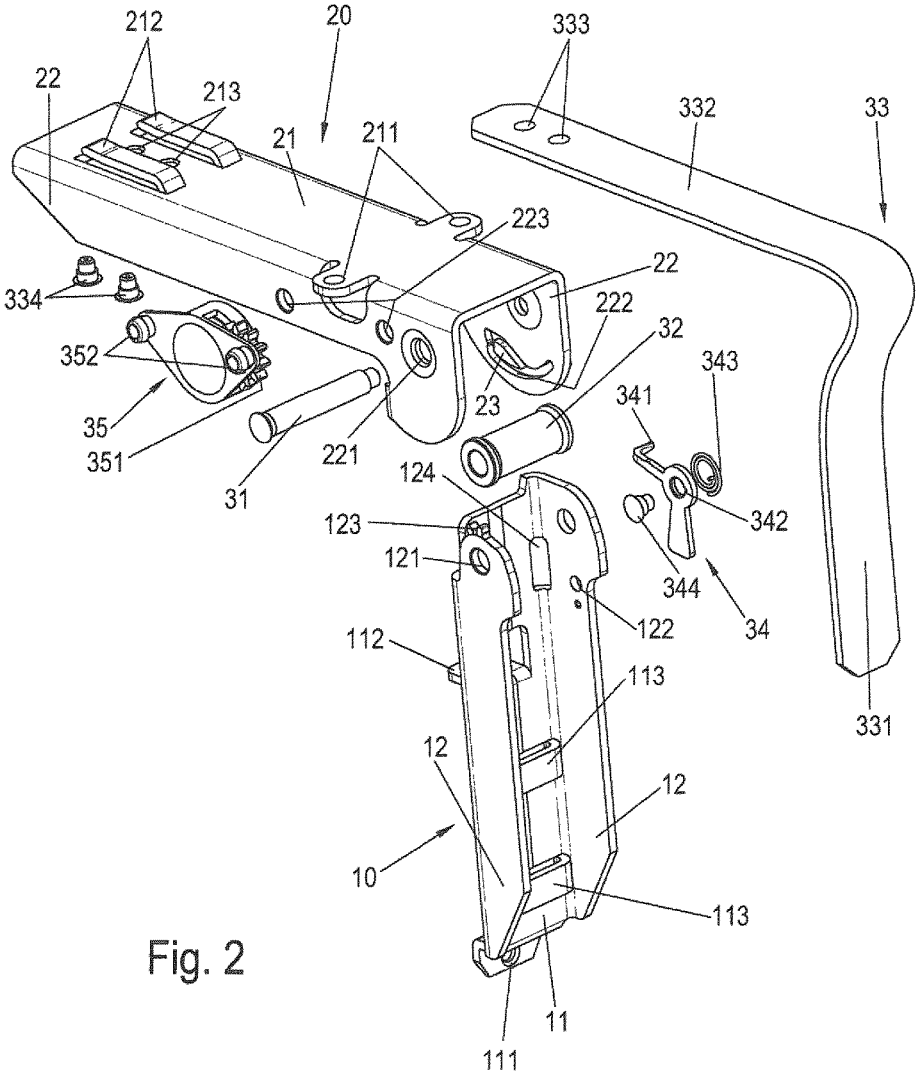
FIG. 2 shows a schematic isometric exploded view of an exemplary embodiment of a hinge.

FIG. 2 shows an exemplary embodiment of a hinge, which has the functionality explained in conjunction with FIGS. 1*a-c*, in a schematic isometric exploded view.

The hinge has a first and a second hinge element 10, 20 which can be installed on a body and lid, respectively, of a domestic appliance, as shown in FIGS. 1*a-c*. Alternatively, the first and second hinge elements 10, 20 could be installed on the lid and body, respectively, of the domestic appliance.

In the illustrated embodiment, both hinge elements 10, 20 are formed as essentially U-shaped with respect to the basic shape thereof, each having a base 11 or 21 and two parallel opposing lateral legs 12 or 22, respectively. Both hinge elements 10, 20 may be produced from sheet metal, for example, a (galvanized) steel plate, a stainless-steel plate, or an aluminum plate in a stamping and bending process. Alternatively, the two hinge elements can also be produced from diecast zinc.

Fastening means are arranged on the respective base 11, 21 of the hinge elements 10, 20, to be able to fasten the hinge elements 10, 20 on the body or on the lid of the domestic appliance. In the present case, fastening holes 111 and 211 and fastening tabs 112 and 212, respectively, are provided as the fastening means. The fastening hole 111 is arranged in this case on a tab formed on an end region of the base 11. The fastening holes 211 are arranged on tabs which lie in the plane of the base 21 but are bent out of the legs 22. Additionally or alternatively to the illustrated fastening means, which are arranged essentially in the region of the base 11 or 21, fastening means, for example, fastening holes can be provided in the legs 12 or 22.

The two hinge elements 10, 20 are adapted to one another with respect to the width thereof (spacing of the respective legs 12 or 22) so that the hinge elements 10, 22 can be joined one inside the other. In the present case, the second hinge element 20 is placed on the first hinge element 10, wherein fastening holes 121 or 221 are provided in the end region in the legs 12, 22, which are located congruently one above another in the assembled state and through which a pin 31 is inserted, which forms a pivot axis of the hinge. The pin is additionally guided by a deflection roller 32, which is thus arranged rotatably mounted between the legs 12 of the first hinge part 10. The pin 31 is preferably riveted after the insertion in the production process.

The illustrated hinge has a spring, due to which the hinge automatically assumes one of the end positions, in the present case the open position, in which the hinge elements 10, 20 are essentially aligned extended in relation to one another, as the base position. In the present case, a leaf spring 33 is provided as the spring, which presses with spring arms 331 or 332 against inner surfaces of the base 11 or the base 21, respectively. The leaf spring 33 can have a single spring leaf or can be a spring packet, which consists of multiple spring leaves located one on top of another. The leaf spring 33 has fastening holes 333 on its free end of the spring arms 332, through which rivets 334 are guided, using which the spring 33 is fastened on the base 21. Corresponding fastening holes 213 for the rivets 334 are provided for this purpose in the base 21. Furthermore, the leaf spring 33 is guided over the deflection roller 32 in the region of the transition between the spring arms 331 and 332 and is inserted in the further proceedings with the spring arm 331 under insertion tabs 113, which are embossed out of the base 11 of the first hinge element. The insertion tabs 113 connect the spring arm 331 to the first hinge element 10, but enable a displacement of the two elements in relation to one another, which results during pivoting of the first in relation to the second hinge element 10, 20.

In an embodiment of the illustrated hinge, the insertion tabs are not embossed directly out of the base 11, but rather are formed on a slide, which is mounted displaceably on the first hinge element 10. By displacing the slide, the effective spring force of the leaf spring 33 can be varied and the spring force can thus be adapted, for example, to different weights or geometries of the lid. Other devices for setting the spring force are also conceivable, for example, a set screw. In alternative embodiments, other spring types can be used as a leaf spring, for example, a tension spring, a compression spring, or a spiral spring.

In FIG. 2, the leaf spring 33 is shown in the form which results in the illustrated hinge position. In principle, the leaf spring 33 is pre-tensioned so that the spring arms 331 and 332 assume an extended or hyperextended position in relation to one another. Accordingly, the hinge is moved into the base position, which corresponds to the open position of the lid 2 shown in FIG. 1*a*, by the leaf spring 33.

In the region of the pivot axis, a control lever 34, which opens at its free end into an angled control pin 341, is rotatably arranged on one of the legs 12 of the first hinge element 10. The control lever 34 has a fastening hole 342, around which the control lever is rotatably mounted on the leg 12. An extension is formed facing downward in the figure on the control lever 34, which is used for weight compensation, so that the control pin 341 assumes a preferred location.

The control lever 34 is rotatably fastened together with a spiral spring 343 with the aid of a rivet 344 in a corresponding fastening hole 122 on the leg 12. The spiral spring 343 engages in a hole (not identified in greater detail in FIG. 2) in the leg 12 and applies a torque to the control lever 34, which acts counterclockwise in the illustration of FIG. 2. The spiral spring 343 therefore assists the effect of the weight-compensating extension. In alternative embodiments of the hinge, it can be provided that both elements are not used, but rather only the spiral spring 343 or only the weight-compensating extension.

Adjacent to the fastening hole 122, a passage 124 is introduced in the corner region between the leg 12 and the base 11, through which the control lever 34 protrudes with its control pin 341. In the assembled state of the hinge, the control pin 341 engages in a control curve 222, which is formed in the applied leg 22 of the second hinge element 20.

The interaction between control lever 34 and control curve 222 causes the functionality of the hinge described in conjunction with FIGS. 1*a*-1*c* and secures the intermediate position shown in FIG. 1*b*, in which the lid 2 engages. The interaction of the control lever 34 and the control curve 222 is explained in greater detail hereafter on the basis of FIGS. 3*a*-3*c*.

Figure 3A:
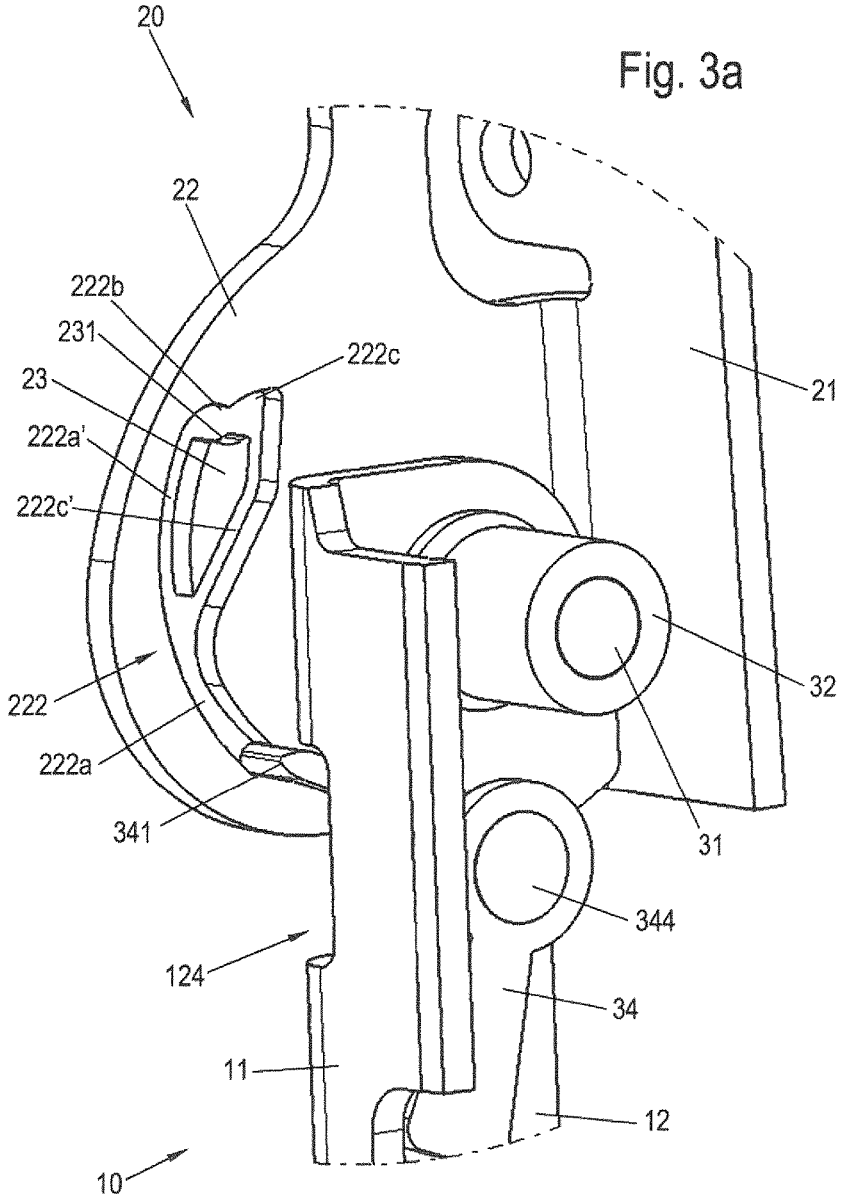
FIGS. 3*a-c* each show a schematic isometric sectional illustration of the region of the pivot axis of the hinge shown in FIG. 2 in various angle positions.
Figure 3B:
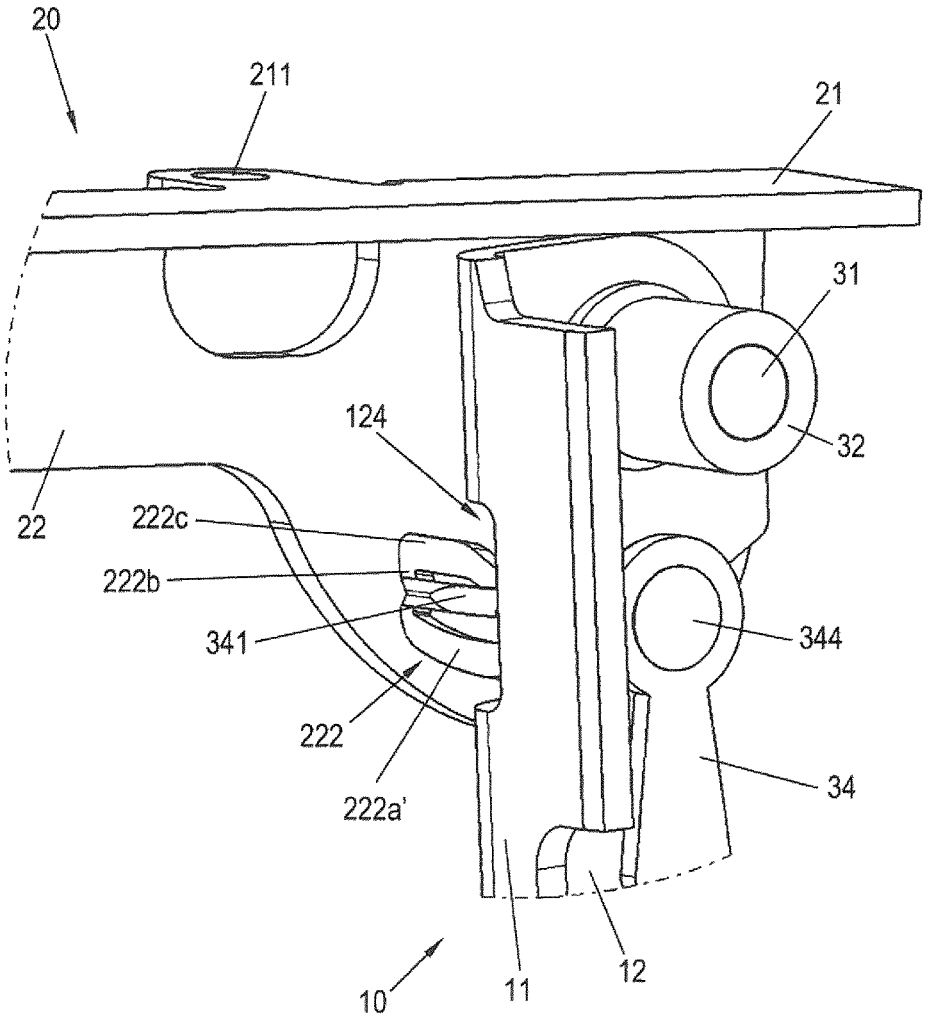
Figure 3C:
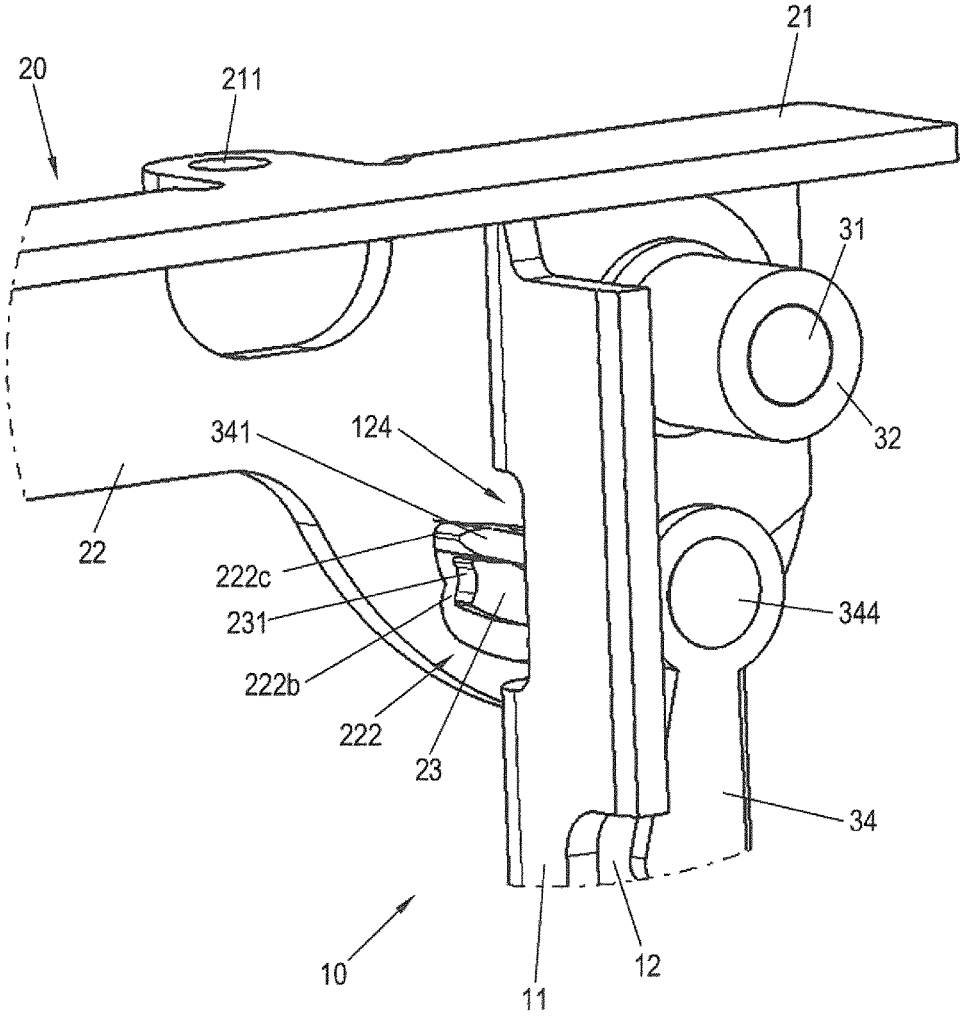

FIGS. 3*a*-3*c* each show, in the same type of illustration, a detail image of the hinge shown in FIG. 2 in an assembled state in an isometric sectional view. The illustrated hinge positions correspond to those shown in FIGS. 1*a*-1*c*, i.e., FIG. 3*a* shows the open position of the hinge having the joint angle $\alpha=\alpha_a$, FIG. 3*b* shows the intermediate position of the hinge at the joint angle $\alpha=\alpha_b$, and FIG. 3*c* shows the closed position of the hinge at the joint angle $\alpha=\alpha_c$.

The control lever 34, which engages with its control pin 341 in the control curve 22 and protrudes through the passage 124, can be seen well in FIGS. 3*a*-3*c*. The control curve 222 is a curve which is closed per se, and which has various sections 222*a*, 222*a*', 222*b*, 222*c*, and 222*c*'.

The sections 222*a*'-c' form a closed, heart-shaped path, on which the section 222*a* adjoins in the lower region. The outer contours of the control curve 222 are stamped out of the leg 22, wherein the circumferential path is formed in that an insert 23, which is also heart-shaped, is inserted centrally into the stamped-out region. The insert 23 can be, for example, a protrusion in a plastic plate, which is placed from the outside in the region of the control curve 222 on the leg 22, preferably clipped on, riveted on, or injection molded on.

Alternatively to the embodiment having the separate insert 23, it can also be provided that the control curve 222 is embossed into the leg 22 in a deep embossing process. In this case, instead of the insert 23, a correspondingly shaped inner region from the material of the leg 22 remains, the outer edge of which represents the inner contour of the control curve.

In the open position of the hinge shown in FIG. 3*a*, the control pin 341 is located at the end of the section 222*a* of the control curve 222. If the second hinge element 20 is pivoted in relation to the first hinge element 10, the control pin 341 travels along the section 222*a* and 222*a*' into the position in the section 222*b* shown in FIG. 3*b*, in which the insert 23 has a catch groove 231. The hinge is held in the intermediate position against the force of the leaf spring 33 acting between the hinge elements 10, 20 by the control pin 341 pressed into the catch groove 231.

The control pin is guided at its front end out of the catch groove 231 by the control curve 222 and enters the section 222*c* first upon the further manual pivoting of the second hinge element 20 into the position shown in FIG. 3*c*.

When the second hinge element 20 is pivoted up out of the position shown in FIG. 3*c*, the control pin 341 leaves the section 222*c* and follows the control curve 222 into the section 222*c*'. This in turn merges into the section 222*a*, so that during the opening of the hinge into the intermediate position, no latching occurs, but rather the hinge moves readily into the open position (FIG. 3*a*).

The correct movement direction of the control pin 341 when passing through the described closing and opening movement is determined by the shape of the control curve 222 and by the spiral spring 343 or the weight-compensated extension on the control lever 34. In addition, in particular in the region of the fork between the sections 222*a* and 222*a*' or 222*c*', a difference can be provided in the depth of the control curve 222 to guide the control pin. For example, at the fork, the transition from the section 222*a* to the section 222*a*' can extend smoothly, while in contrast a step is formed on the bottom of the control curve 222 toward the section 222*c*'. The step prevents a transition of the control pin 341 from the section 222*a* into the section 222*c*'. Such a depth variation in the control curve 222 presumes a certain elasticity of the control lever 34 per se or due to its mounting.

It is provided in a standard form that the intermediate position of the hinge shown in FIG. 3*b* is left by continuing the closing movement. However, during use of the domestic appliance, in which the hinge is used, it is not possible to prevent the lid from also being pivoted upward by the user from the intermediate position.

To suppress excessively large forces acting on the insert 23 or the control pin 341 for this case, in an embodiment of the hinge, it is provided that one of the two elements, the control pin 341 or the insert 23, can yield to release the occurring latching.

For example, the control curve 222 can be beveled in the region of the catch groove 231 so that an increased force acting between the two mentioned elements causes the control lever 34 to yield transversely in relation to its rotational axis. For this purpose, the control lever 34 can be embodied as spring-like, for example. The control pin 341 then moves over the surface of the insert 23, until it engages in the control curve 222 again in one of the sections 222*a*', 222*c*', or 222*a*. Instead of a spring-like control lever 34, a yielding capability can also be provided for the control lever 34 in its mounting, for example, such that the pivot axis of the control lever 34 can tilt and thus the control pin 341 can leave the control curve in case of overload.

Instead of the elastic control lever 34, it can alternatively or additionally be provided that the insert 23 can yield outward in a direction perpendicular to the surface of the leg 22. For example, the plate which bears the insert 23 and is placed externally on the leg 22 can be spring-like and can be fastened on only one side on the leg 22, so that the insert 23 can yield outward.

In the hinge shown in FIG. 2, a damping function is furthermore provided, which damps an opening movement of the hinge upon approach to the open position. For this purpose, a damper designed as a rotation damper 35 is fastened on the second hinge element 20.

The rotation damper 35 has a gearwheel 351, the rotational movement of which is damped in one rotational direction. A gearwheel segment 123, which consists in the present case of two teeth, is formed on one of the legs 12 of the first hinge element. The gearwheel segment 123 can particularly preferably be formed in one piece with the first hinge element 10 in the above-described stamping process. The interaction of the gearwheel segment 123 with the gearwheel 351 of the rotation damper 35 is described in greater detail hereafter on the basis of FIGS. 4*a* and 4*b*. Fastening holes 223, in which the damper 35 is secured with the aid of rivets 352, are introduced into one of the legs 22 for fastening the rotation damper 35.

Figure 4A:
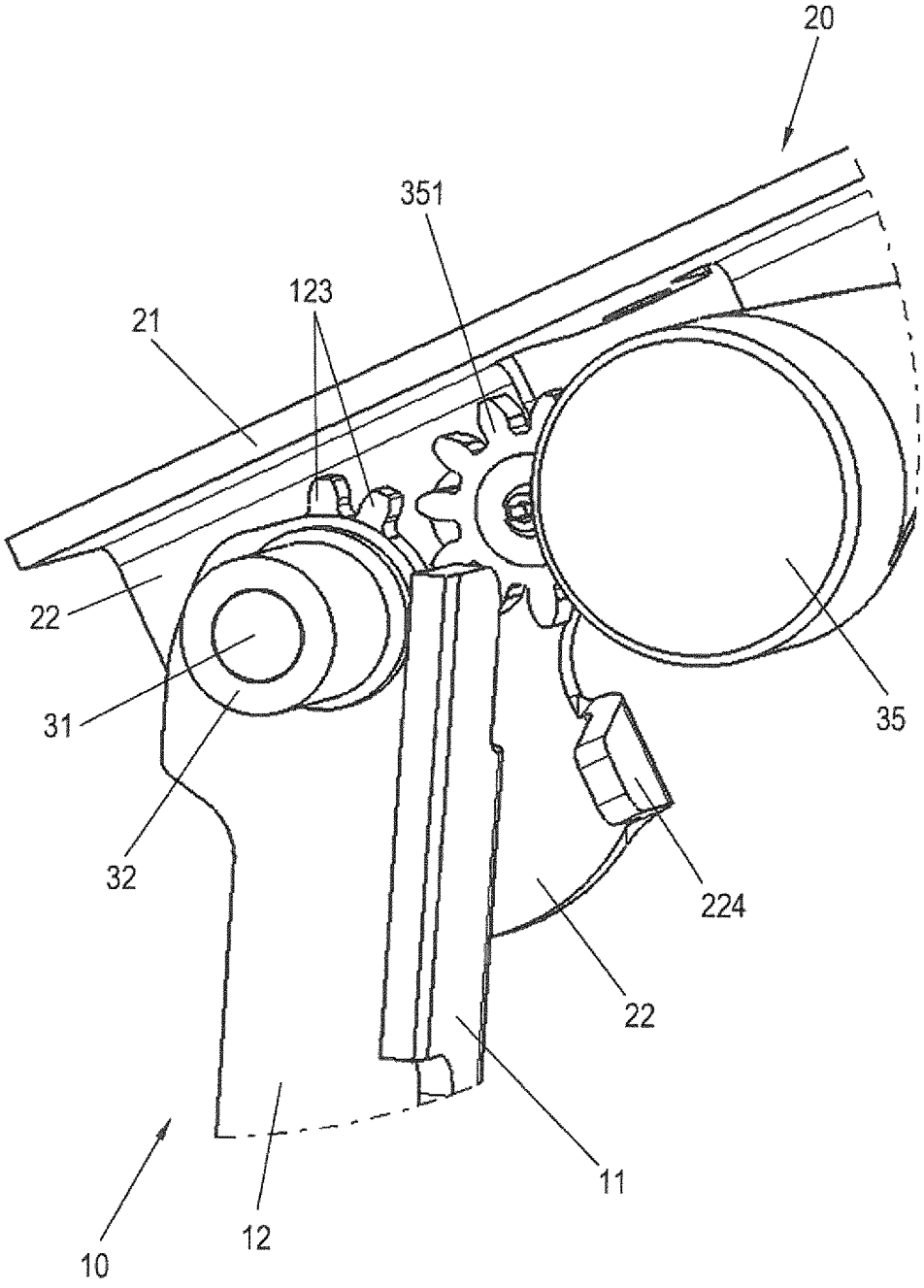
FIGS. 4*a, b* each show a further isometric sectional illustration of the region of the pivot axis of the hinge from FIG. 2 in various angle positions.
Figure 4B:
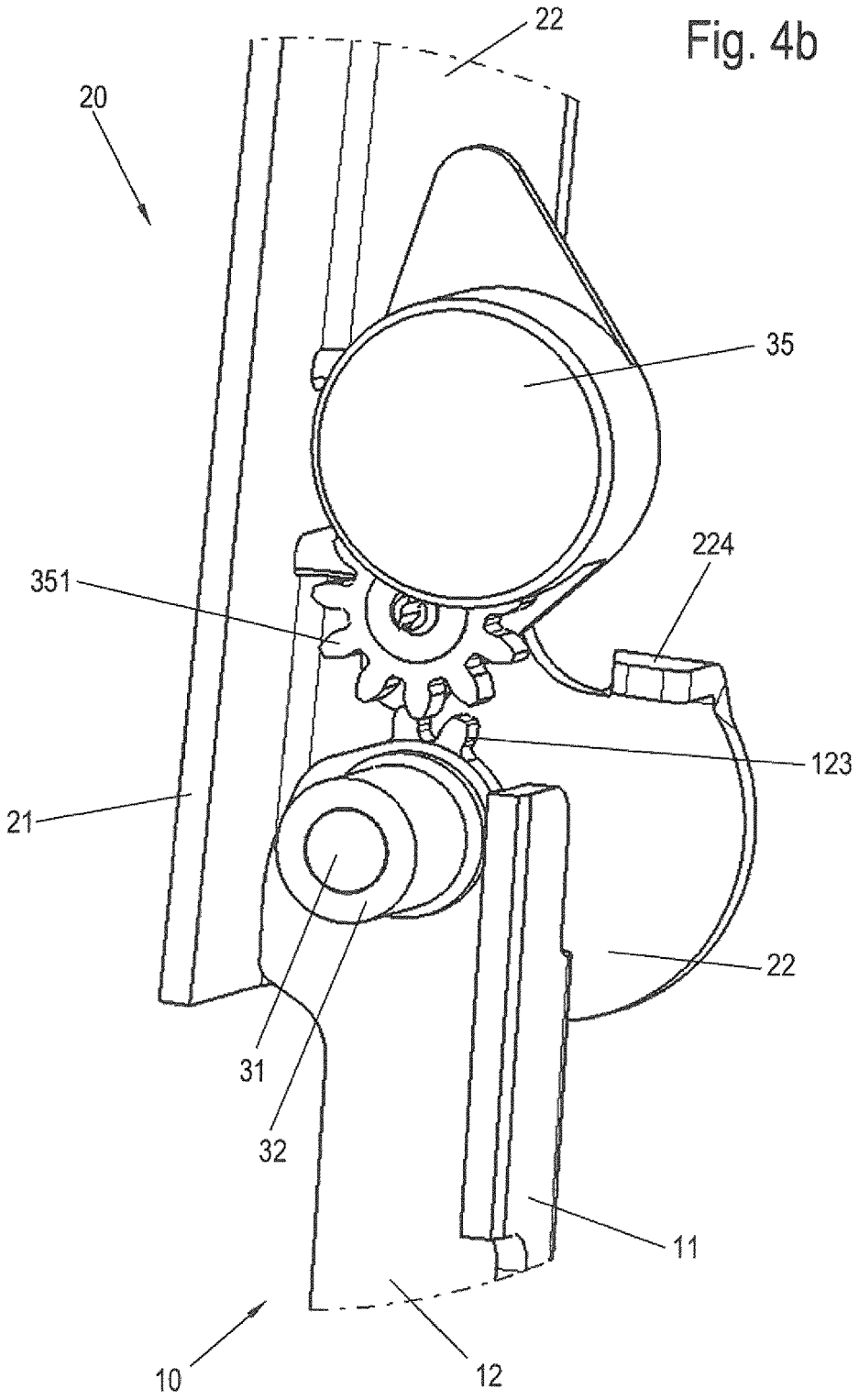

In FIGS. 4*a* and 4*b*, in a similar manner as in FIGS. 3*a*-3*c*, isometric sectional illustrations are shown, which show the region of the pivot axis of the hinge in FIG. 2 in detail in two different angle positions of the hinge. In comparison to the viewing directions of the illustration of FIGS. 3*a*-*c*, the opposite side of the hinge is shown here, in which the rotation damper 35 is arranged.

FIG. 4*a* shows a partially open position of the hinge, in which the gearwheel 351 of the rotation damper 35 is not engaged with the gearwheel segment 123 of the leg 12 of the first hinge element. Accordingly, two hinge elements 10, 20 can be pivoted in relation to one another in an undamped manner.

During further movement of the hinge in the opening direction, the gearwheel 351 engages in the gearwheel segment 123 and is accordingly rotated relative to the second hinge element 20 during pivoting of the second hinge element 20 in relation to the first hinge element 10. The rotation damper 35 damps this rotational movement of the gearwheel 351 and therefore also the pivot movement of the second hinge element 20 in relation to the first hinge element 10. The engagement of the gearwheel 351 in the gearwheel segment 123 is shown in the open position of the hinge in FIG. 4*b*.

FIGS. 4*a* and 4*b* also show the end stops for the closed and open positions of the hinge. With respect to the open position, an end stop occurs in that the base 21 of the second leg 20 presses against the legs 12 of the first hinge element 10 in the open position. The legs 12 are formed accordingly for this purpose, to define the open angle $\alpha_c$, which is somewhat less than 180° in the present case. To limit the joint angle during the closing movement, a stop 224 is bent over on at least one of the legs 22, which presses against the base 11 of the first hinge element in the closed position.

The invention claimed is:

1. A hinge for a domestic appliance for pivotable fastening of a lid on a body of the domestic appliance, having a first hinge element and a second hinge element, which are pivotably connected to one another and can be pivoted in relation to one another between an open position and a closed position, wherein a control lever is rotatably mounted on the first hinge element and a control curve is formed on the second hinge element, in which a control pin formed on the control lever is guided, wherein a catch is formed into the control curve and is configured to engage and selectively hold the control pin during a closing movement of the hinge, but not during an opening movement of the hinge, so that an intermediate position of the hinge is assumed and held when the hinge is moved from the open position toward the closed position until the closing movement is continued into the closed position, while in contrast during an opening movement of the hinge out of the closed position, the hinge pivots into the open position, and wherein the first and the second hinge elements are formed as U-shaped, each having a base and legs arranged laterally on the base, wherein the legs of the first hinge element are disposed between the legs of the second hinge element in the region of a pivot axis extending through the legs of the first and second hinge elements.

2. The hinge according to claim 1, wherein the first and the second hinge element are produced from sheet metal in a stamping and bending process.

3. The hinge according to claim 1, wherein the control lever is mounted on one of the legs of the first hinge element and the control curve is formed in one of the legs of the second hinge element.

4. The hinge according to claim 1, wherein the control curve at least sectionally forms a circumferential path for the control pin.

5. The hinge according to claim 4, wherein the circumferential path of the control curve extends in a heart shape.

6. The hinge according to claim 4, wherein an outer contour of the control curve is formed by a recess in one of the legs of the second hinge element and an inner contour of the circumferential path of the control curve is formed by an insert, which is inserted into the recess in the leg one of the legs of the second hinge element.

7. The hinge according to claim 6 wherein the control lever is elastic so that the control pin may disengage from the catch groove and the control curve during an opening movement of the hinge.

8. The hinge according to claim 6 wherein the control lever is elastically mounted on the first hinge element so that the control pin may disengage from the catch groove and the control curve during an opening movement of the hinge.

9. The hinge according to claim 6 wherein the insert is elastically mounted on the second hinge element so that the control pin may disengage from the catch groove and the control curve during an opening movement of the hinge.

10. The hinge according to claim 4, wherein a further section of the control curve, in which the control pin enters in the open position of the hinge, adjoins the circumferential path of the control curve.

11. The hinge according to claim 1, wherein the control curve is embossed in a deep embossing process in one of the legs of the second hinge element.

12. The hinge according to claim 1, having a damper connected between the first hinge element and the second hinge element, which at least sectionally damps a movement of the two hinge elements in relation to one another.

13. The hinge according to claim 12, wherein the damper is a rotation damper having a gearwheel, which is fastened on one of the hinge elements, wherein a gearwheel segment, in which the gearwheel engages, is formed on the other of the hinge elements.

14. The hinge according to claim 13, wherein the gearwheel engages in the gearwheel segment upon approach to at least one of the open position and the closed position of the hinge.

15. The hinge according claim 1, having a spring which is arranged between the two hinge elements.

16. The hinge according claim 15, wherein the spring is a leaf spring.

17. A domestic appliance having a body on which a lid is pivotably fastened using at least one hinge according to claim 1.

18. The domestic appliance according claim 17, wherein the domestic appliance is a top loading washing machine.

* * * * *